US008794699B1

(12) United States Patent
Rudolfo

(10) Patent No.: US 8,794,699 B1
(45) Date of Patent: Aug. 5, 2014

(54) COLLAPSIBLE CHAIR HAVING FOLDABLE ARM TRAY

(76) Inventor: Joan P Rudolfo, Boston, MA (US)

( * ) Notice: Subject to any disclaimer, the term of this patent is extended or adjusted under 35 U.S.C. 154(b) by 953 days.

(21) Appl. No.: 12/906,588

(22) Filed: Oct. 18, 2010

(51) Int. Cl.
*A47C 7/62* (2006.01)

(52) U.S. Cl.
USPC ..... 297/184.15; 297/344.18; 297/162; 297/118

(58) Field of Classification Search
USPC ..... 297/31, 160, 162, 135, 344.18, 17, 118, 297/119, 184.15
See application file for complete search history.

(56) References Cited

U.S. PATENT DOCUMENTS 1,529,077 A 3/1925 Gentaro
1,541,105 A 6/1925 Broome
4,252,371 A * 2/1981 Lehnen ..... 297/411.4
4,300,798 A * 11/1981 Musgrove et al. ..... 297/184.15
D286,626 S 11/1986 Britz
4,681,249 A * 7/1987 Kondo ..... 228/37
6,059,365 A * 5/2000 Diamond ..... 297/354.13
6,109,685 A * 8/2000 Lindsey et al. ..... 297/40
6,213,555 B1 * 4/2001 Sulpizio et al. ..... 297/377
D455,262 S 4/2002 Krulik
D473,065 S 4/2003 Wilson
6,722,783 B2 4/2004 Jackson, Sr. et al.
7,493,667 B2 2/2009 Ferco, III et al.
7,832,804 B2 * 11/2010 LaFreniere ..... 297/411.32
2004/0055085 A1 3/2004 Boscaro

* cited by examiner

*Primary Examiner* — David R Dunn
*Assistant Examiner* — Jody Giacoman

(57) ABSTRACT

The collapsible chair having foldable arm tray is a device that can convert from a chair to a fold out bed to a collapsed state for towing and/or storage. The collapsible chair when configured as a chair includes an optional footrest, an optional canopy to provide shade from the elements, an optional arm tray folds out above the seat, and a lumbar support. The collapsible chair, when configures as a bed, fully extends to support an end user. The collapsible chair can collapse and includes wheels and a handle for towing when not in use.

6 Claims, 6 Drawing Sheets

COLLAPSIBLE CHAIR HAVING FOLDABLE ARM TRAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of collapsible chairs, more specifically, a collapsible chair that includes in addition to a multitude of features, an arm tray.

B. Discussion of the Prior Art

As a preliminary note, it should be stated that there is an ample amount of prior art that deals with collapsible chairs generally. As will be discussed immediately below, no prior art discloses a collapsible chair that can convert from a chair to a bed, and further includes a headrest or canopy that extends over the head of an end user to provide shade when the collapsible chair is used as a chair, and further includes an arm tray that rotates to provide a surface upon which to store items thereon, and further includes a lumbar support for the end user when the collapsible chair is configured as a chair, and further includes includes telescoping legs to support the collapsible chair when configured as a chair, and further includes wheels to mobilize the collapsible chair when collapsed or configured as a chair.

The Ferko, III Patent (U.S. Pat. No. 7,493,667) discloses a folding bed or cot particularly for use as a portable medical bed that includes a center base portion connected to a support frame. However, the folding bed does not convert to a chair having a lumbar support, arm tray, canopy, or footrest.

The Boscaro Patent Application Publication (U.S. Pub. No. 2004/0055085) discloses a folding bed with a central dolly. However, the folding bed does not convert to a chair and include a canopy, footrest, or arm tray.

The Jackson, Sr. Patent (U.S. Pat. No. 6,722,783) discloses a portable, padded chair made from X-ray transparent materials that includes a tray and may convert to a bed. However, the chair does not feature a canopy that converts to a headrest when the chair is converted to a bed.

The Matsushita Patent (U.S. Pat. No. 1,529,077) discloses a combined collapsible chair and bed. Again, the chair does not feature a canopy that doubles as the headrest when the chair is converted to a bed.

The Broome Patent (U.S. Pat. No. 1,541,105) discloses a combination seat and bed that includes wheels for storage. Again, the seat does not feature a canopy that doubles as the headrest when the chair is converted to a bed.

The Britz Patent (U.S. Pat. No. Des. 286,626) illustrates an ornamental design for an invalid chair that includes a tray, which does not depict a canopy.

While the above-described devices fulfill their respective and particular objects and requirements, they do not describe a collapsible chair that can convert from a chair to a bed, and further includes a headrest or canopy that extends over the head of an end user to provide shade when the collapsible chair is used as a chair, and further includes an arm tray that rotates to provide a surface upon which to store items thereon, and further includes a lumbar support for the end user when the collapsible chair is configured as a chair, and further includes a foot rest for use when configured as a chair, and further includes telescoping legs to support the collapsible chair when configured as a chair, and further includes wheels to mobilize the collapsible chair when collapsed or configured as a chair. In this regard, the collapsible chair having foldable arm tray departs from the conventional concepts and designs of the prior art.

SUMMARY OF THE INVENTION

The collapsible chair having foldable arm tray is a device that can convert from a chair to a fold out bed to a collapsed state for towing and/or storage. The collapsible chair when configured as a chair includes an optional footrest, an optional canopy to provide shade from the elements, an optional arm tray folds out above the seat, and a lumbar support. The collapsible chair, when configures as a bed, fully extends to support an end user. The collapsible chair can collapse and includes wheels and a handle for towing when not in use.

It is an object of the invention to provide a collapsible chair that doubles as a bed and of which can collapse when not in use and be towed or stored.

A further object of the invention is to provide a headrest for the bed that can double as a canopy when the bed is converted to a chair.

A further object of the invention is to provide a footrest for the bed that can be used as a footrest for the chair.

A further object of the invention is to include an arm tray that can rotate about an armrest and of which can support items thereon.

These together with additional objects, features and advantages of the collapsible chair having foldable arm tray will be readily, apparent to those of ordinary skill in the art upon reading the following detailed description of presently preferred, but nonetheless illustrative, embodiments of the collapsible chair having foldable arm tray when taken in conjunction with the accompanying drawings.

In this respect, before explaining the current embodiments of the collapsible chair having foldable arm tray in detail, it is to be understood that the collapsible chair having foldable arm tray is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible chair having foldable arm tray.

It is therefore important that the claims be regarded as including such equivalent construction insofar as they do not depart from the spirit and scope of the collapsible chair having foldable arm tray. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
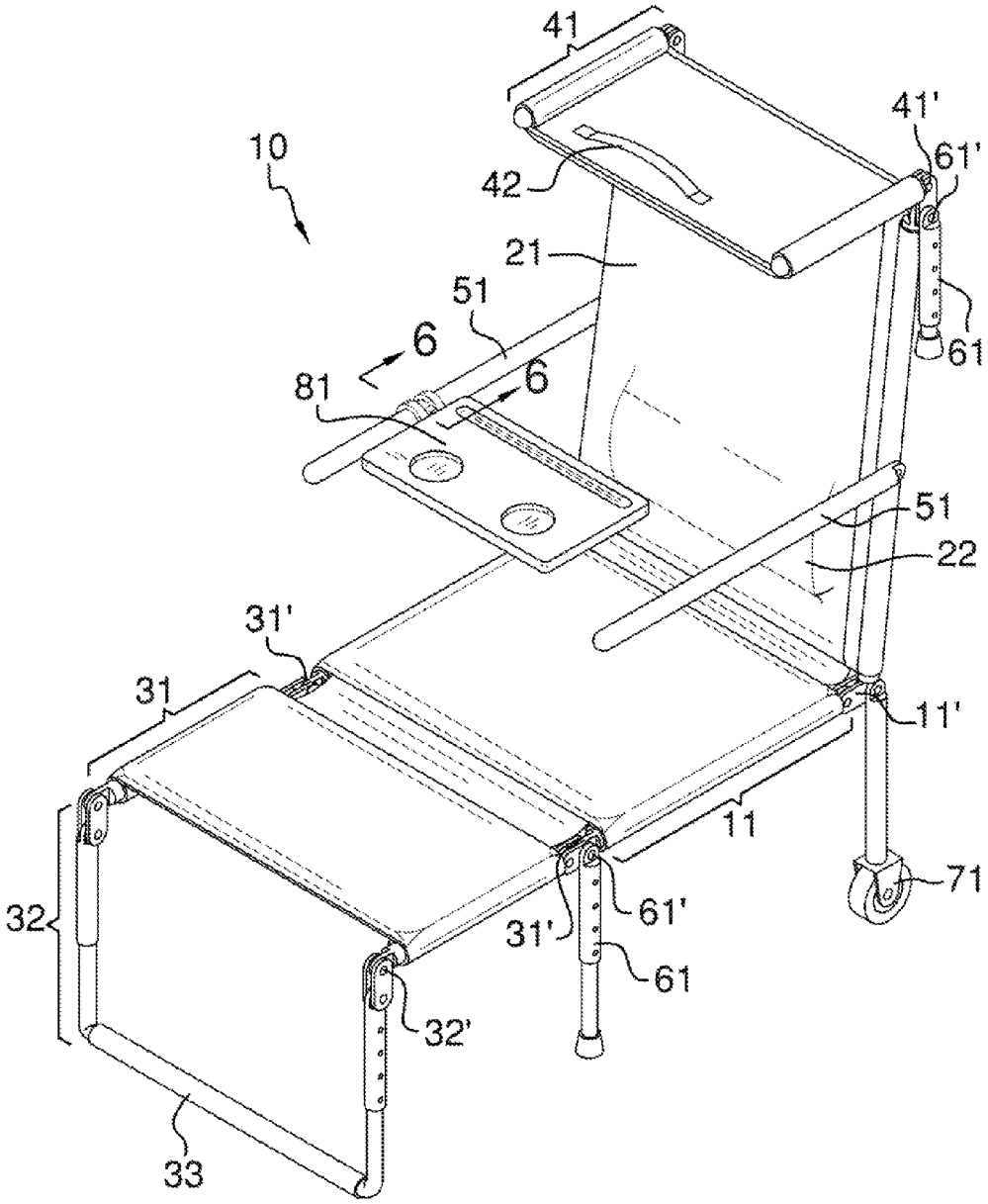
FIG. 1 illustrates a front, isometric view of the collapsible chair having foldable arm tray configured as a chair with the foot rest extended, the canopy rotated over to act as a shade, and with the arm tray extended above the seat.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A collapsible chair having foldable arm tray 10 (hereinafter invention) includes a seat 11, a seat back 21, a foot rest 31, a head rest 41, arms 51, telescoping legs 61, wheels 71, arm tray 81.

The seat 11 is adjacent the seat back 21, and both the seat 11 and the seat back 21 are attached via first hinges 11' such that the seat back 21 can rotate 180 degrees with respect to the seat 11. The seat back 21 can be rotated 90 degrees with respect to the seat 11, when the invention 10 is configured for use as a chair (see FIGS. 1 and 4). Additionally, the seat back 21 can be rotated to 180 degrees with respect to the seat 11, when the invention 10 is configured for use as a bed (see FIGS. 2 and 3). Additionally, the seat back can be rotated to 0 degrees with respect to the seat 11, when the invention 10 is configured to a collapsed state (see FIG. 5).

The wheel 71 attaches to the first hinge 11' and is capable of rotating irrespective of either the seat 11 and the seat back 21. The wheel 71 is designed to provide mobility to the invention 10 when configured to a collapsed state (see FIG. 5). Additionally, the wheel 71 is to provide support to the seat 11 and to the invention 10 when configured as either a chair or as a bed.

The seat back 21 features a lumbar support 22 that is designed to support the back of an end user when the invention 10 is configured for use as a chair. The lumbar support 22 also provides support to the back of an end user when the invention 10 is configured as a bed.

The arms 51 attach along sides of the seat back 21 via arm hinges 51'. The arms 51 support arms of an end user when the invention 10 is configured for use as a chair. The arms 51 can rotate via the arm hinges 51' to an extended state for use with the chair configuration (see FIG. 1) or fold away when not needed when the invention 10 is configured as a bed (see FIG. 2).

The arms 51 may further support the arm tray 81, which attaches to the armrests 51 via a pivoting hinge 82. The pivoting hinge 82 enables the arm tray 81 to rotate about the arm 51 and also enables the arm tray 81 to be locked into a particular position with respect to the arm 51 in order to support items (not depicted) placed upon the arm tray 81. The pivoting hinge 82 attaches onto the arm 51, and further includes a pivoting arm 82A that receives a pivoting ball 82B that is mounted onto the arm tray 81.

The footrest 31 is adjacent to and attached to the seat 11 via a seat hinge 31'. The footrest 31 is for use in supporting the lower extremities of an end user when the invention 10 is configured for use as a bed. Additionally, the footrest 31 may be extended for use as a support for the legs of an end user when the invention 10 is configured for use as a chair. The footrest 31 may additionally be retracted away and not used by an end user when the invention 10 is configured for use as a chair.

The footrest 31 is supported by a telescoping leg 32 that attaches to the footrest via a footrest hinge 32'. The telescoping leg 32 includes a cross brace 33 that when extended engages the surrounding ground to provide stability to the footrest 31 and the invention 10.

Two of the telescoping legs 61 are situated between the seat 11 and the footrest 31 and provide support to the invention 10 when configured as a chair or as a bed. The telescoping legs 61 attach to the invention 10 via leg hinges 61' and can rotate independent of the seat 11, the footrest 31, or the seat hinge 31'. It shall be noted that all of the telescoping legs 61 are adjustable in length.

The headrest 41 is adjacent the seat back 21, and is attached thereon via a headrest hinge 41'. The headrest 41 can rotate 180 degrees via the headrest hinge 41'. The headrest 41 can extend out to 180 degrees with respect to the seat back 21 to an extended state when the invention 10 is configured as a bed (see FIG. 2). Additionally, the headrest 41 may be rotated to 90 degrees with respect to the seat back 21, and thus doubles as a canopy to provide shade to an end user when the invention 10 is configured as a chair (see FIG. 1). The headrest 41 may be rotated to 0 degrees with respect to the seat back 21 when the invention 10 is collapsed (see FIG. 5). A handle 42 is located on a back side of the headrest 41 and provides a means by which to pull the invention 10 via the wheels 71 when the invention 10 is in a collapsed state (see FIG. 5).

Two of the telescoping legs 61 are situated between the seat back 21 and the headrest 41 and provide support to the invention 10 when configured as a chair or as a bed. The telescoping legs 61 attach to the invention 10 via leg hinges 61' and can rotate independent of the seat back 21, the headrest 41, or the headrest hinge 41'.

Figure 2:
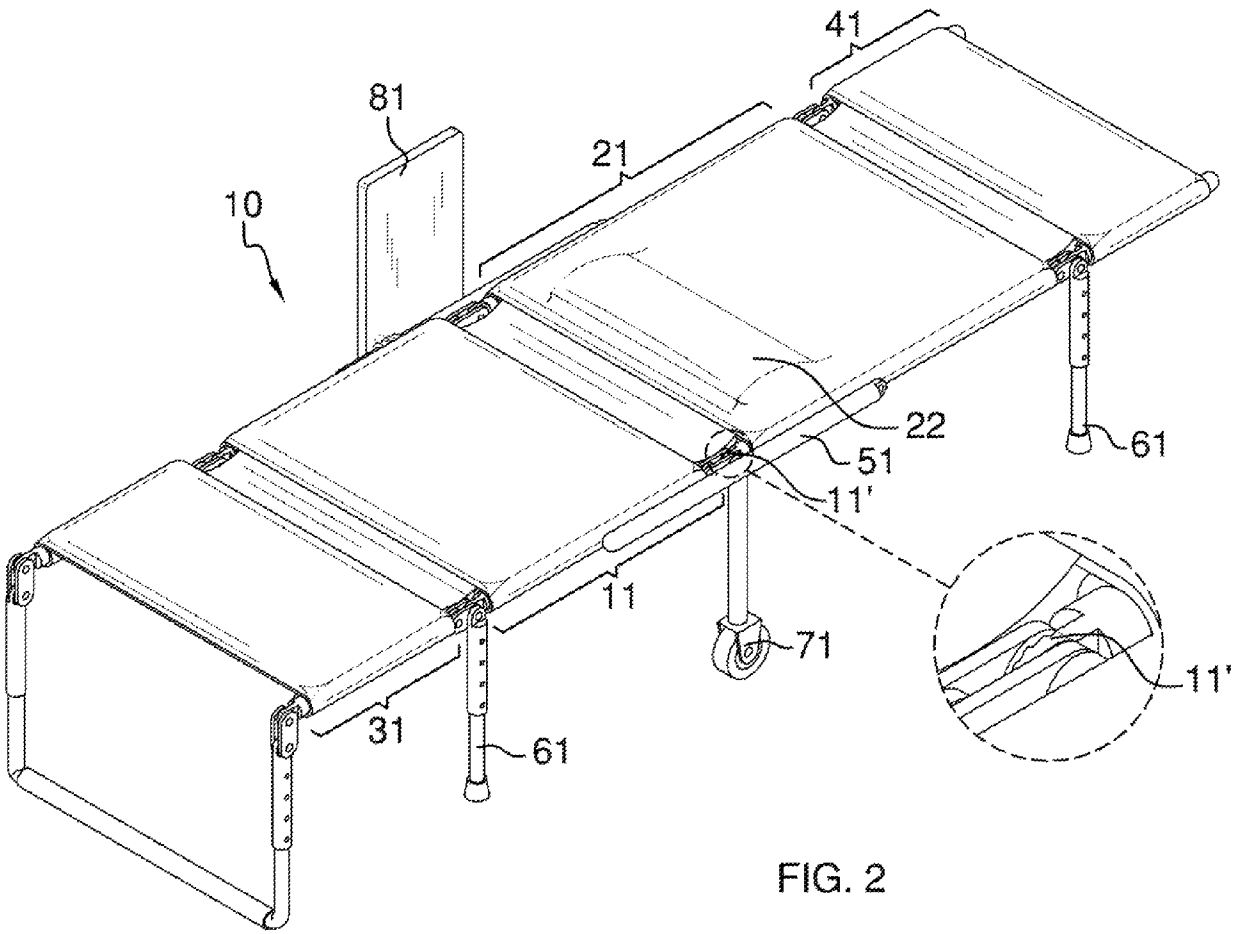
FIG. 2 illustrates a front, isometric view of the collapsible chair having foldable arm tray configured as a bed with both the foot rest and head rest extended, and depicting the arm tray rotated to a vertical position, and including a detail of the ratchet hinge located between the seat and seat back.
Figure 3:
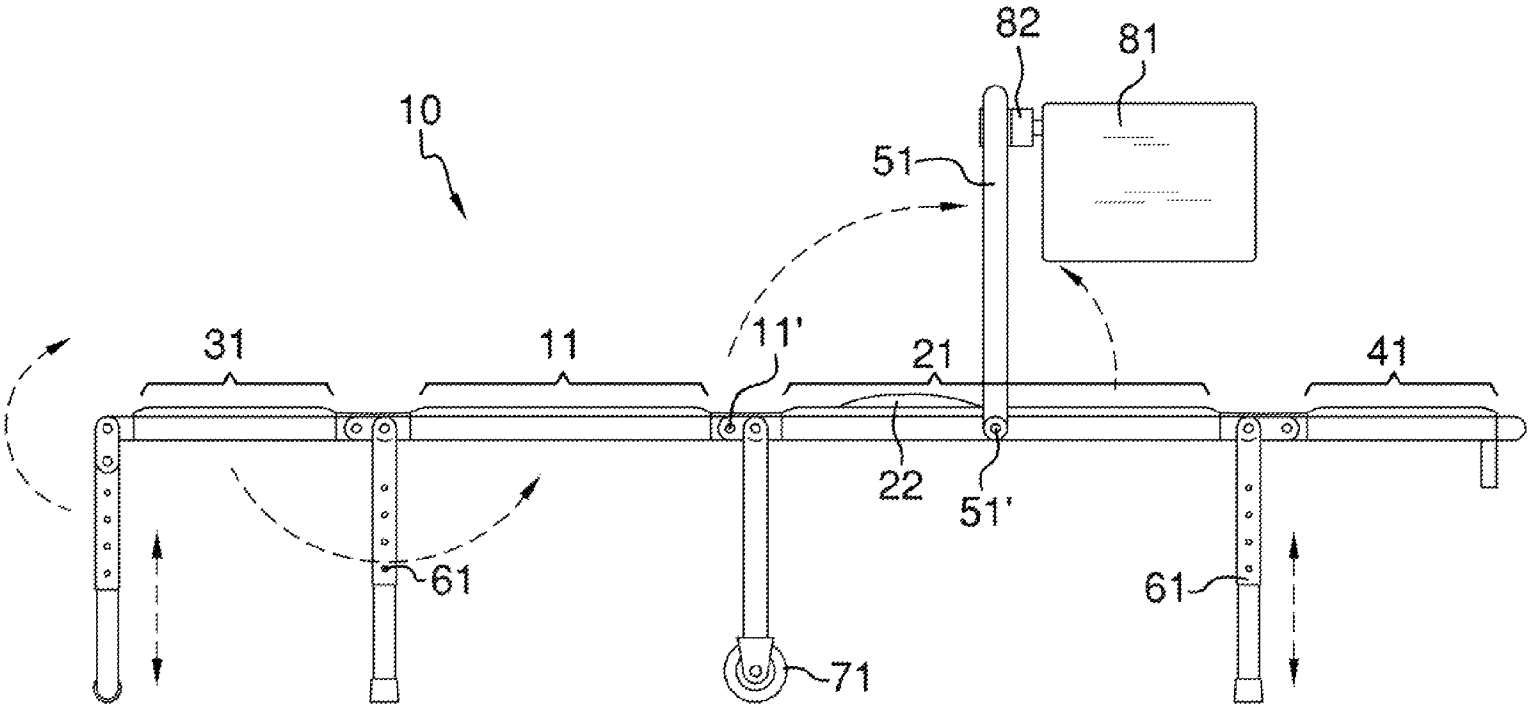
FIG. 3 illustrates a side view of the collapsible chair having foldable arm tray and including multiple rotational and vertical arrows to represent movement of the various telescoping legs as well as a rotational arrow to depict movement of the arm tray.
Figure 4:
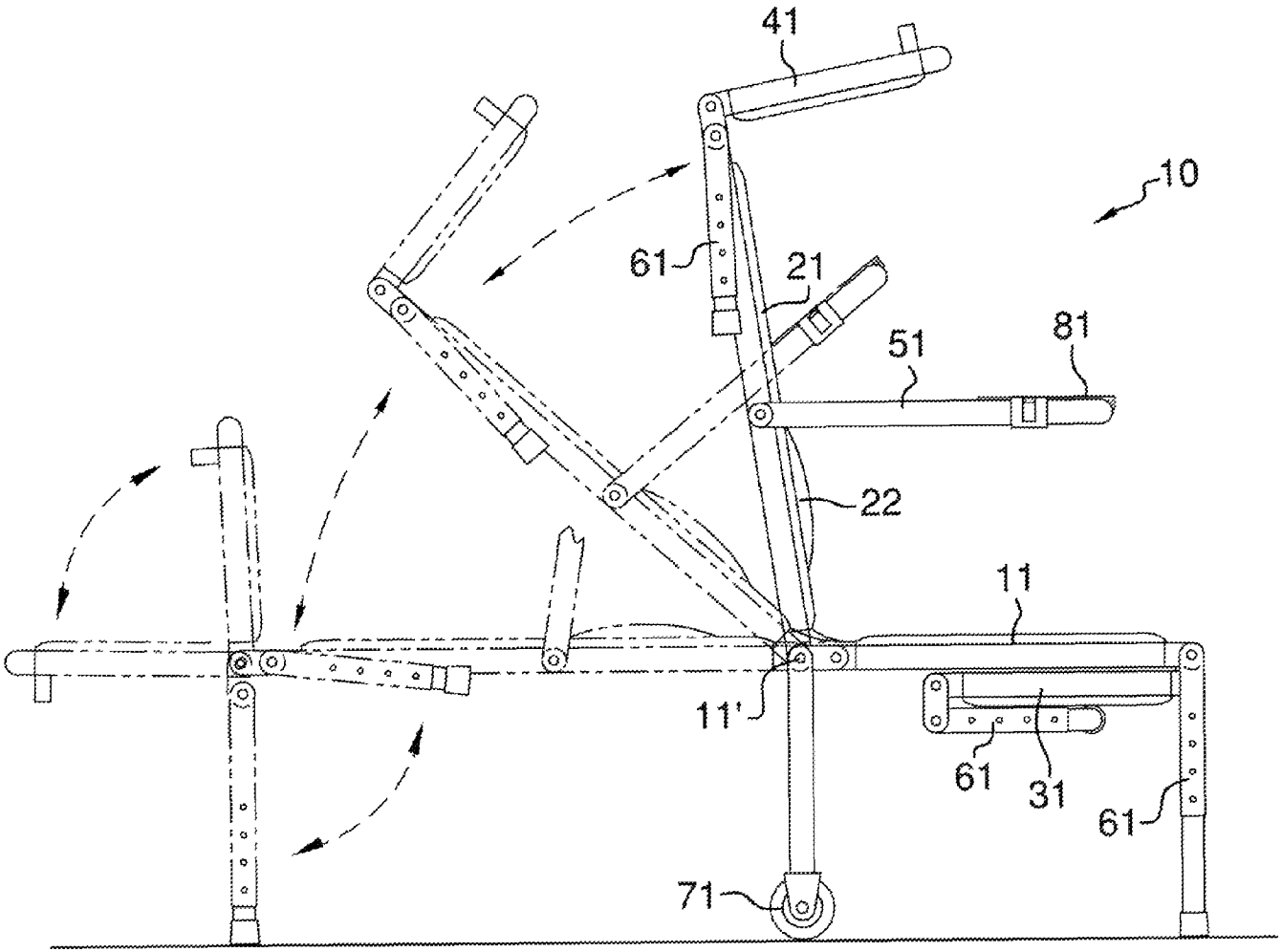
FIG. 4 illustrates a side view of the collapsible chair having foldable arm tray configured as a chair and depicting the canopy extended over the seat, and depicting retraction of the footrest and supporting telescoping leg, and depicting the ratchet hinge rotating the seat back at different angles with respect to the seat.
Figure 5:
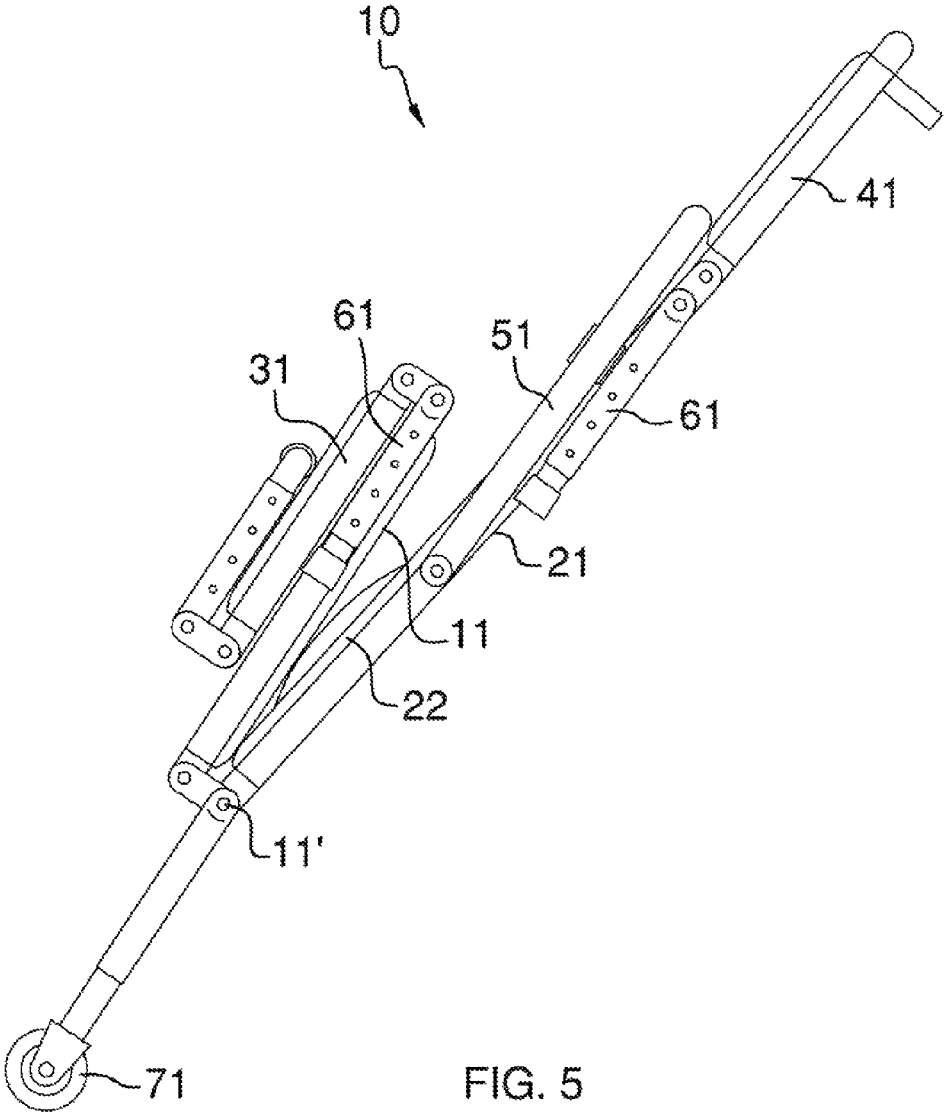
FIG. 5 illustrates a side view of the collapsible chair having foldable arm tray in a collapsed configuration at an angle with wheels touching the surrounding ground to indicate mobilization of the invention.
Figure 6:
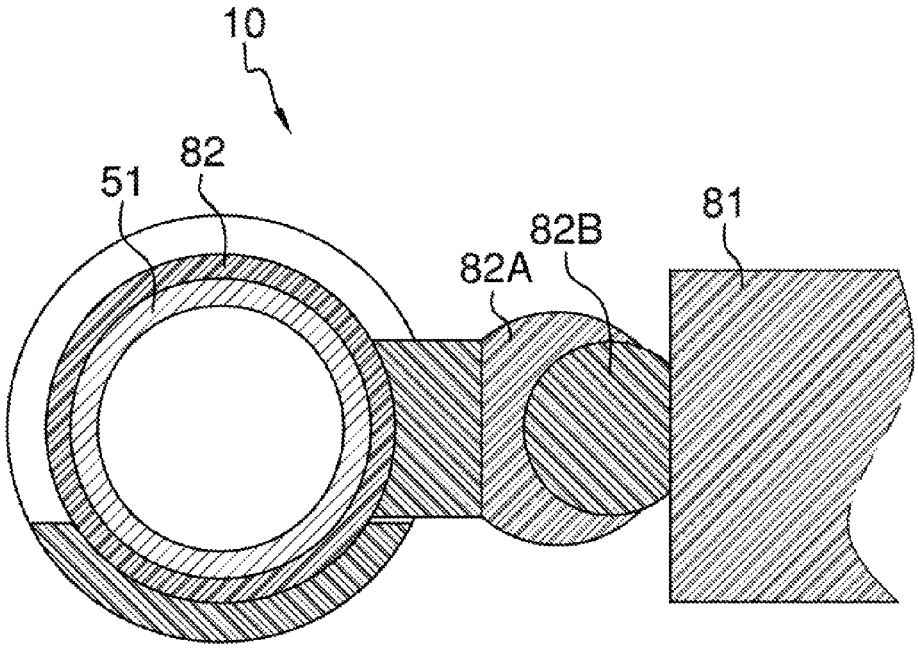
FIG. 6 illustrates a cross-sectional view of the collapsible chair having foldable arm tray along line 6-6 in FIG. 1 and depicting the armrest and supporting structure of the arm tray.

Referring to FIGS. 2 and 4, the first hinges 11' are a ratcheting hinge that can lock the seat back 21 at different angles with respect to the seat 11. In particular to FIG. 4, the first hinges 11' can lock the seat back 21 at a 180 degrees, 135 degrees, and 90 degrees with respect to the seat 11.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A collapsible chair, further comprising:

a seat attached to a seat back via first hinges;

wherein a headrest is attached to said seat back via headrest hinges and can double as a canopy when said seat and seat back are configured as a chair;

wherein a footrest is attached to said seat via footrest hinges and can extend to support lower extremities when said seat and seat back are configured as a chair or as a bed;

wherein a plurality of telescoping legs are attached via leg hinges and support the collapsible chair as a chair or as a bed;

wherein the seat, the seat back, the headrest, and the footrest can fold flat to collapse when not in use;

a pair of arms are attached along sides of the seat back via arm hinges;

wherein an arm tray attaches onto one of the arms via a pivoting hinge;

wherein wheels are attached between said seat and seat back via leg hinges and of which support the seat and seat back when configured as a chair or as a bed, and to mobilize when in said collapsed state;

wherein a handle is located on a back surface of the headrest and is used to pull the collapsible chair via the wheels when in the collapsed state;

wherein the footrest includes an additional telescoping leg that extends to support said footrest;

wherein the telescoping leg includes a cross brace;

wherein the pivoting hinge enables the arm tray to rotate to and lock into a particular position with respect to the armrest;

wherein the seat back includes a lumbar support.

2. The collapsible chair as described in claim 1 wherein the headrest includes telescoping legs that extend to support said headrest.

3. The collapsible chair as described in claim 1 wherein the first hinges are ratcheting hinges such that the seat back can lock at different angles with respect to the seat.

4. A collapsible chair, further comprising:

a seat attached to a seat back via first hinges;

wherein a headrest is attached to said seat back via headrest hinges and can double as a canopy when said seat and seat back are configured as a chair;

wherein a footrest is attached to said seat via seat hinges and can extend to support lower extremities when said seat and seat back are configured as a chair or as a bed;

wherein a plurality of telescoping legs are attached via leg hinges and support the collapsible chair as a chair or as a bed;

wherein the seat, the seat back, the headrest, and the footrest can fold flat to collapse when not in use;

wherein wheels are attached between said seat and seat back via first hinges and of which support the seat and seat back when configured as a chair or as a bed, and to mobilize when in said collapsed state;

wherein a handle is located on a back surface of the headrest and is used to pull the collapsible chair via the wheels when in the collapsed state;

a pair of arms are attached along sides of the seat back via arm hinges;

wherein an arm tray attaches onto one of the arms via a pivoting hinge;

wherein the footrest includes an additional telescoping leg that extends to support said footrest;

wherein the telescoping leg includes a cross brace;

wherein the pivoting hinge enables the arm tray to rotate to and lock into a particular position with respect to the armrest;

wherein the seat back includes a lumbar support;

wherein the headrest includes telescoping legs that extend to support said headrest.

5. The collapsible chair as described in claim 4 wherein the first hinges are ratcheting hinge such that the seat back can lock at different angles with respect to the seat.

6. A collapsible chair, further comprising:

a seat attached to a seat back via first hinges;

wherein the first hinge are ratcheting hinges such that the seat back can lock at different angles with respect to the seat;

wherein a headrest is attached to said seat back via headrest hinges and can double as a canopy when said seat and seat back are configured as a chair, and telescoping legs are attached via leg hinges and extend to support said headrest;

wherein a footrest is attached to said seat via seat hinges and can extend to support lower extremities when said seat and seat back are configured as a chair or as a bed, and a telescoping leg is attached via leg hinges and extends to support said footrest;

wherein a plurality of telescoping legs are attached via leg hinges and support the collapsible chair as a chair or as a bed;

wherein the seat, the seat back, the headrest, and the footrest can fold flat to collapse when not in use;

wherein wheels are attached between said seat and seat back via first hinges and of which support the seat and seat back when configured as a chair or as a bed, and to mobilize when in said collapsed state;

wherein a handle is located on a back surface of the headrest and is used to pull the collapsible chair via the wheels when in the collapsed state;

a pair of arms are attached along sides of the seat back via arm hinges;

wherein an arm tray attaches onto one of the arms via a pivoting hinge;

wherein the telescoping leg of the footrest includes a cross brace;

wherein the pivoting hinge enables the arm tray to rotate to and lock into a particular position with respect to the armrest;

wherein the seat back includes a lumbar support.

* * * * *